US009481432B2

(12) United States Patent
Dogliotti et al.

(10) Patent No.: US 9,481,432 B2
(45) Date of Patent: Nov. 1, 2016

(54) BOAT SAIL COMPRISING SHAPE MEMORY MATERIAL ELEMENTS, APPARATUS AND METHOD FOR ITS OPERATION

(71) Applicants: SAES GETTERS S.P.A., Lainate (IT); Andrea Dogliotti, Genoa (IT)

(72) Inventors: Andrea Dogliotti, Genoa (IT); Francesco Butera, Como (IT)

(73) Assignee: SAES GETTERS S.P.A., Lainate (MI) (IT)

( * ) Notice: Subject to any disclaimer, the term of this patent is extended or adjusted under 35 U.S.C. 154(b) by 0 days.

(21) Appl. No.: 14/911,720

(22) PCT Filed: Jul. 17, 2015

(86) PCT No.: PCT/IB2015/055431

§ 371 (c)(1),
(2) Date: Feb. 11, 2016

(87) PCT Pub. No.: WO2016/012919

PCT Pub. Date: Jan. 28, 2016

(65) Prior Publication Data

US 2016/0221656 A1 Aug. 4, 2016

(30) Foreign Application Priority Data

Jul. 24, 2014 (IT) ..... MI2014A1346

(51) Int. Cl.
*B63H 9/06* (2006.01)
*B63H 9/08* (2006.01)

(52) U.S. Cl.
CPC ..... *B63H 9/0657* (2013.01); *B63H 9/0642* (2013.01); *B63H 2009/0678* (2013.01); *B63H 2009/082* (2013.01); *B63H 2009/088* (2013.01)

(58) Field of Classification Search
CPC ..... B63H 9/04; B63H 9/06; B63H 9/0657; B63H 9/08; B63H 9/10; B63H 2009/088; B63B 35/79
USPC ..... 114/39.11, 39.29, 97, 98, 102.22, 114/102.26, 102.27
See application file for complete search history.

(56) References Cited

U.S. PATENT DOCUMENTS 4,337,090 A 6/1982 Harrison
4,830,262 A 5/1989 Ishibe
5,367,970 A 11/1994 Beauchamp et al.

(Continued)

FOREIGN PATENT DOCUMENTS

WO 2011/088189 A2 7/2011
WO 2014/128599 A1 8/2014

OTHER PUBLICATIONS

International Search Report issued for International Application No. PCT/IB2015/055431 filed on Jul. 17, 2015 in the name of Saes Getters S.P.A. et al. Mail date: Nov. 26, 2015.

(Continued)

*Primary Examiner* — Lars A Olson
(74) *Attorney, Agent, or Firm* — Steinfl & Bruno, LLP

(57) ABSTRACT

Sails for sailboat wind propulsion comprising shape memory systems containing shape memory elements are described. The shape memory systems are arranged in correspondence to the sail battens, extending along them and operably connected to the sail opposite faces or directly to the battens so as to face the opposite faces of the sail. A control apparatus and method of said sails is also described.

24 Claims, 2 Drawing Sheets

(56) References Cited

U.S. PATENT DOCUMENTS

| | | | |
|---|---|---|---|
| 8,152,941 | B2 | 4/2012 | Sczerzenie et al. |
| 8,430,981 | B1 | 4/2013 | Sczerzenie et al. |
| 9,327,813 | B2 | 5/2016 | Dogliotti |
| 2007/0138341 | A1 | 6/2007 | Joshi et al. |
| 2011/0168072 | A1 | 7/2011 | Cross |

OTHER PUBLICATIONS

Written Opinion issued for International Application No. PCT/IB2015/055431 filed on Jul. 17, 2015 in the name of Saes Getters S.P.A. et al. Mail date: Nov. 26, 2015.

Voorhees, A. et al. "Shape memory alloys could transform yachting." SMST E-Elastic Newsletter, 3 pgs. Jul. 2010.

Voorhees, A. Supermaxi: The Victory of Adaptive and Transformable Technologies. Oceanshaker. Oct. 16, 2009. 5 pgs. Internet Publication (www.oceanshaker.com). Feb. 11, 2016.

Communication under Rule 71(3) mailed on May 20, 2015 for EP Application No. 14707247 filed on Feb. 13, 2014 in the name of Andrea Dogliotti. 28 pages.

PCT International Search Report mailed on May 13, 2014 for PCT/IB2014/058972 filed on Feb. 13, 2014 in the name of Andrea Dogliotti. 3 pages.

PCT Written Opinion mailed on May 13, 2014 for PCT/IB2014/058972 filed on Feb. 13, 2014 in the name of Andrea Dogliotti. 5 pages.

Non-Final Office Action for U.S. Appl. No. 14/765,232, filed Jul. 31, 2015 on behalf of Andrea Dogliotti. Mail Date: Feb. 26, 2016. 7 pages.

Notice of Allowance for U.S. Appl. No. 14/765,232, filed Jul. 31, 2015 on behalf of Andrea Dogliotti. Mail Date: Mar. 16, 2016. 7 pages.

BOAT SAIL COMPRISING SHAPE MEMORY MATERIAL ELEMENTS, APPARATUS AND METHOD FOR ITS OPERATION

CROSS REFERENCE TO RELATED APPLICATIONS

The present application is the U.S. national stage entry of International Patent Application No. PCT/IB2015/055431, filed internationally on Jul. 17, 2015, which, in turn, claims priority to Italian Patent Application No. MI2014A001346, filed on Jul. 24, 2014.

The present invention generally relates to sailboat wind propulsion and more particularly to sails for sailboats comprising shape memory systems containing elements made of shape memory materials, said shape memory systems being arranged in correspondence to sail battens.

Sail adjustment methods based on the idea of employing shape memory systems have recently been suggested.

The international patent application PCT/IB2014/058972 in the name of one of the inventors e.g. discloses the use of shape memory elements for the adjustment of boat sails, as well as an apparatus and a method for their operation and control.

The article "Shape memory alloys could transform yachting" by Adam Voorhees, published on Jul. 1 2010 on SMST E-Elastic newsletter, pages 1-3 proposes to manufacture boat sails provided with a shape memory alloy skeleton allowing to transform them from static or passive to dynamic or active structures, so as to achieve optimum performances at each sailing angle, wind speed and, more generally, sea condition.

The author of the article above has also disclosed further information on this topic over the internet in a post published on Oct. 16, 2009 titled: "Supermaxi, the victory of adaptive and transformable technologies". The post may be retrieved at the link set forth below:

http ://oceanshaker.com/2009/10/16/supermaxi-the-victory-of-adaptive-and-transformable-technologies/.

In this post the author teaches, although rather speculatively, the use of shape memory materials for making sail battens. However, this solution has some drawbacks, in particular because in order to make battens exhibiting an adequate structural resistance an excessive amount of shape memory material is required, which leads to an increase in the sail weight and hence to poor performances.

The international publication WO 2011/088189 A2 discloses a sail control device for a sail comprising one or a number of flexible tensioning members extending from a forward portion of the sail, along a body portion thereof up to an after portion of the same sail. The flexible members are movably attached to the sail body and are slidable relative to the sail so as to change the shape of its after portion.

The tensioning members may be restrained to a Cunningham line or to a dedicated pulling line other than the Cunningham line for operating the sail shape control device.

According to WO 2011/088189 A2, the flexible tensioning members are made of a strong, lightweight, flexible material such as yarns of e.g. aramid fibers or liquid crystal polymers and may radiate outwardly from a lower forward portion of the sail. The free end of each of the tensioning members is attached to the after portion of a sail such as the leech or a batten pocket.

There is still the need to improve sail control devices and in particular those employing shape memory systems, which is an object of the present invention. In a first aspect thereof the invention relates to a sail for sailboats having one or more battens, wherein a pair of shape memory systems are operably connected to at least one of said battens and wherein said shape memory systems are arranged on opposite sides of the batten relative to the sail surface and comprise one or more shape memory elements extending along said battens.

The idea underlying the invention is therefore to control the battens of a boat sail by way of shape memory systems stretching out along them, thus allowing to have a dynamic control of the sail without affecting its overall structure and weight.

The term shape memory system broadly encompasses any structure incorporating one or more shape memory elements. Such elements may be e.g. wires or ribbons, as well as a plurality of shape memory elements grouped in patterns, as for example described in the aforementioned international patent application PCT/IB2014/058972. In the case of metallic shape memory wires the preferred wire diameter is comprised between 0.1 and 2 mm.

Also, the shape memory systems may not run along the whole length of the battens, but on at least 75% of their length, more preferably 90%. Such length coverage may equivalently be achieved by more systems close to each other, even if such solution is not the optimal one.

The term "batten" usually indicates a single element, but for the purposes of the present invention this term also encompasses elements that are joined together or that are arranged in close proximity (typically less than 5 cm) to each other, i.e. elements that from the functional standpoint of sail control are equivalent to a batten made up of a single element.

The invention will be further illustrated with the help of the following figures wherein.

Figure 5:
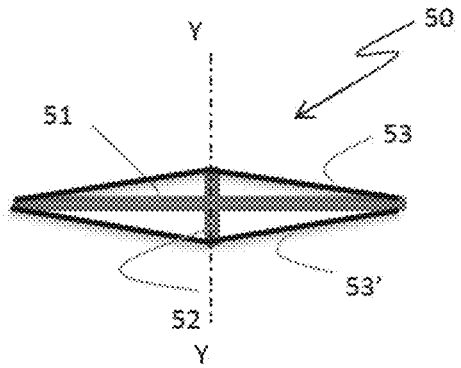
FIGS. 5 is a top view of a further embodiment of the sail according to the invention.

5A is a cross sectional view taken along a plane passing through line Y-Y of FIG. 5.

The dimensions and dimensional ratios of the elements shown in the drawings have been altered in order to facilitate their understanding. In particular, the thicknesses of the shape memory systems in the cross sectional views have been enlarged to clearly show their arrangement relative to the batten and the sail surface. Moreover, for the sake of clarity additional elements that are not essential for the understanding of the invention, such as e.g. electrical connections and cables/wires, have not been shown in the drawings.

The present invention is based on the use of pairs of shape memory systems operably connected to the sail battens so as to control their curvature. The inventors have observed in fact that sail battens are the most stressed structural components of a sail and hence the most effective portions on which dynamic adjustment of the sail may be implemented.

The sails according to the present invention have at least one batten that is subjected to the control of a pair of shape memory systems operably connected thereto. The shape memory systems are connected to the batten such that the shortening associated with their activation and the resulting traction force determines bending of the batten. The bending degree may be chosen, and hence controlled, by adjusting the traction force exerted by the shape memory systems.

According to an embodiment of the invention, the shape memory systems arranged on opposite sides of the batten are alternately actuated.

All the embodiments of the invention envision pairs of shape memory systems extending along the sail battens.

Differently from the aforementioned international publication WO 2011/088189 A2 the sail shape is controlled by way of adjustable members, i.e. the shape memory systems, arranged such that they extend along the battens and by making the adjustable members of a shape memory material or alloy.

Such a configuration of the shape memory systems may not be derived from the above mentioned article and post by Adam Voorhees, either. On the one hand in fact a skeleton of active SMA elements in a synergistic skeleton-muscle arrangement with a passive membrane is taught, no information being provided as to a possible relationship with sail battens, and on the other hand manufacturing of sail battens with shape memory materials is suggested, which is a completely different technical solution leading to an increase in the sail weight and hence to poor dynamic performances, as discussed above.

According to an embodiment of the invention, the shape memory systems of each pair are directly mounted on the respective batten. In this case it is preferred that the shape memory systems are connected close to the batten ends, preferably at a distance from each end being not greater than 20% of the batten length. Even more preferably the shape memory systems are connected at the batten ends.

In an alternative embodiment of the invention, the shape memory systems of each pair are restrained to the opposite faces of the sail in correspondence to a sail batten.

In a further alternative embodiment of the invention, the shape memory systems of each pair are fitted inside the pockets formed in the sail to receive the battens and fixed to the pockets inner surfaces so as to face opposite longitudinal sides of a batten.

In a still further embodiment of the invention the shape memory systems of each pair are connected to the ends of a batten and spaced from its longitudinal sides by way of a distal element that is preferably placed in the middle portion of the batten.

Figure 1:
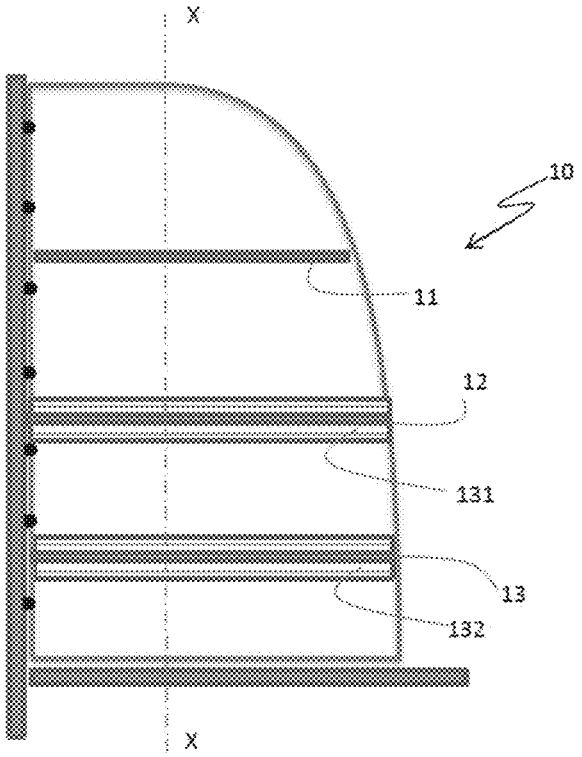
FIG. 1 shows a side view of a sail according to the present invention.

FIG. 1 shows a side view of an exemplary sail 10 according to the present invention. The sail comprises e.g. three battens 11, 12, 13 two of which, e.g. battens 12, 13, are operably connected to respective pairs 131, 131', 132, 132' of shape memory systems. In FIG. 1 only elements 131 and 132 of these pairs are shown, the respective other members of each pair, namely 131' and 132', being located on the opposite side of the sail.

The shape memory systems shown in FIG. 1 may e.g. comprise a plurality of shape memory wires parallel to each other and grouped together.

The preferred wire diameter is comprised between 0.1 and 2 mm.

The sails according to the present invention are characterized by the presence of at least one pair of shape memory systems arranged on opposite sides of the sail in correspondence to at least one sail batten and operably connected thereto.

It is not essential that all sail battens are operably connected to respective pairs of shape memory systems, even though such solution is the preferred one.

Figure 2:
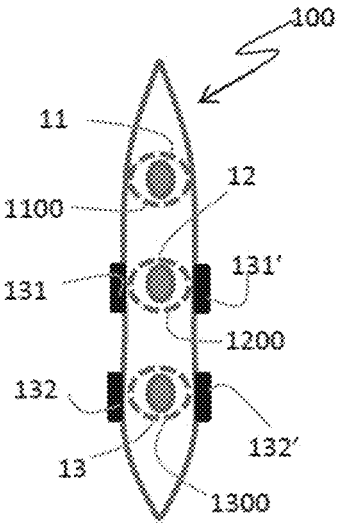
FIGS. 2-4 are cross sectional views taken along a plane passing through line X-X in FIG. 1 respectively showing three different embodiments of the sail according to the present invention.

FIG. 2 shows a cross sectional view of a sail 100 according to an embodiment of the present invention. As it may be seen, the three battens 11, 12, 13 are fitted in respective pockets 1100, 1200, 1300 formed in the sail, and the pairs 131, 131', 132, 132' of shape memory systems are arranged and fixed on the opposite faces of the sail in correspondence to two of the battens, namely battens 12 and 13.

Figure 3:
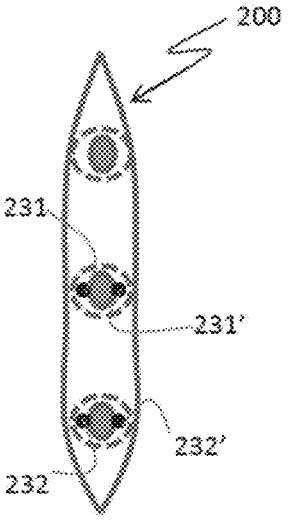

FIG. 3 shows a cross sectional view of a sail 200 according to an alternative embodiment of the invention. In this case the pairs of shape memory systems are pairs of parallel wires 231, 231' and 232, 232', placed in direct contact along battens 12, 13 and arranged together with them inside their respective pockets.

The shape memory wires of each pair are mounted on the respective battens so as to be close to the sail opposite faces and therefore to properly exert their function.

Figure 3A:
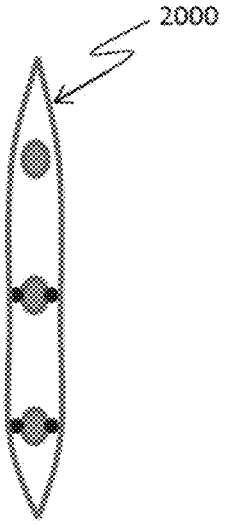

FIG. 3A shows a sail 2000 according to a further alternative embodiment of the invention. The configuration of the sail 2000 is substantially the same of the sail 200 of FIG. 3, the only difference being that battens and related pairs of shape memory wires are directly embedded in the sail structure. In other words, no batten pockets are formed in the sail. This is to underline that the presence of pocket housing the sail battens is not an essential feature of the invention, although generally preferred.

Figure 4:
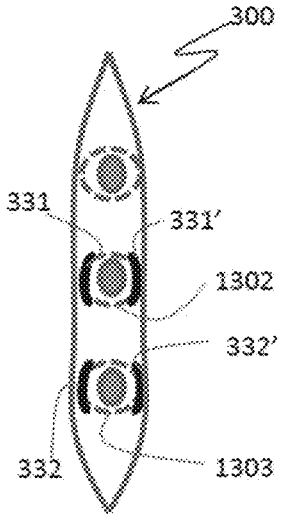

FIG. 4 shows a sail 300 according to another embodiment of the present invention. In this case the shape memory systems of each pair 331, 331' and 332, 332'are arranged and fixed to the inner surfaces of the respective batten pockets 1302, 1303 so as to face the opposite longitudinal sides of the batten.

Figure 5A:
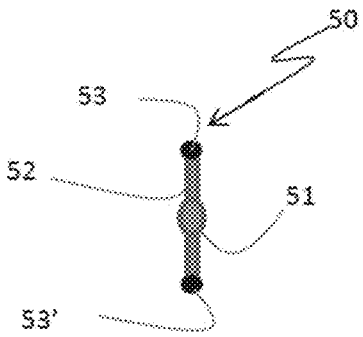

FIGS. 5 and 5A respectively show a top view and a cross sectional view of a portion of a sail 50 according to a still further embodiment of the invention. In this case a batten 51 of the sail 50 comprises a distal element 52, which is preferably located in its middle portion. The shape memory system operably connected to the batten 51 comprises two shape memory wires 53, 53' arranged on its opposite longitudinal sides and restrained to its ends. Each wire is spaced from the batten 51 by the distal element 52, whereby the wires 53, 53' do not run parallel to the batten 51 but are inclined relative thereto as clearly shown in FIG. 5.

More generally, in the case of shape memory systems comprising single filiform elements preferred is a direct connection to the batten. When employing more complex shape memory systems e.g. comprising grouped wires, it is instead preferred to attach them onto the opposite faces of the sail or fix them inside the pockets housing the battens.

The shape memory systems may be embedded or fitted in the sail structure e.g. during manufacturing or simply externally applied to their faces.

The shape memory systems may be part of the sail material itself or incorporated therein by way of soldering, gluing, sewing, molding, laminating, printing, sandwiching (for multilayers sails), crimping, equivalents or combinations thereof. The external application of shape memory systems to the sail faces is particularly suitable for the retrofitting of existing sails.

Shape memory systems incorporated in a sail as disclosed above are connected to and powered by a control apparatus of the sail according to the invention. More particularly, the shape memory systems are connected to electric terminals restrained to the supporting structure of the sail. The electric terminals are in turn connected to an electric interface operably connected to an electrical power source.

The power supply may advantageously be adjustable. To this aim the control apparatus may comprise manual drivers. Automatic or semi-automatic control of the power supply is also possible and to this aim the control apparatus may comprise a microprocessor storing a control program possibly configured to receive external inputs from one or more sensors installed at predetermined positions of the sail and/or on the sailboat where the sail is mounted. Further sensors may also be installed on other non-active portions of the sail in order to gather comparison and reference data.

Such sensors may be e.g. pressure, strain, distortion, wind speed and wind direction sensors preferably installed onto the sail in correspondence of the central part of the batten. The sensors are operably connected to the microprocessor through a circuit and/or from a wireless connection by way of an antenna and provide the microprocessor with external inputs allowing to operate the shape memory systems not only based on the control program stored in the microprocessor, but also taking into account external and environmental conditions, thus improving control of the sail. In a preferred embodiment the shape memory systems are automatically regulated to compensate for the batten curvature.

Other inputs to the microprocessor could be provided through one or more supplementary input units operably connected thereto.

The current supplied to the sail shape memory systems depends on the number, size and type of shape memory elements incorporated in a shape memory system. In the preferred case of shape memory wires, a current comprised between 100 mA and 20 A is supplied to every one of them. Those skilled in the art will understand that the current values are related to the wire size. In view of this the ratio between current and diameter is preferably comprised between 1000 and 10000 mA/mm.

The invention is not directed to any particular type nor shape of sail and may be advantageously applied to sails for small tonnage sailboats, as well as to sails for luxury yachts. Hence, independently of the boat rigging a sail of the invention may be the mainsail, but also an auxiliary sail such as a jib sail, a mizzen sail, a fore sail and the like.

It is known that when elements made of a shape memory alloy are thermally actuated they are shortened by a well predictable percentage which is up to about 8%-9% depending on the material and amount of heat.

Among the class of shape memory materials suitable for the purposes of the present invention there are shape memory polymers and shape memory alloys. It is known that filiform components made of a shape memory alloy undergo shortening upon heating when their structure is subject to a phase change from martensitic (low temperature phase) to austenitic (high temperature phase).

Each alloy is typically characterized by four reference temperatures indicated by the acronyms "As", "Af", "Ms" and "Mf", respectively. "As" indicates the temperature at which the initial transition from Martensitic to Austenitic structure occurs due to heating, "Ms" indicates the temperature at which the reverse transition from Austenitic to Martensitic structure occurs when cooling starts. As in the case of the invention, cooling is often a passive cooling, resulting from the interruption of the heating step as a consequence of power supply interruption. "Af" and "Mf" indicate the temperatures at which complete phase changes occur. Shape memory alloys suitable for the purposes of the present invention preferably have an "Mf" temperature equal to or higher than 40° C. and an "As" temperature that is preferably about 10-20° C. higher than "Mf" temperature.

The other two reference temperatures characterizing the hysteresis cycle of a shape memory alloy play a marginal role for the purposes of the present invention.

Shape memory alloys trained to specific transition temperatures are widely available on the market and such alloys and their properties are well known to those skilled in the art.

Ni—Ti based shape memory alloys, such as Nitinol, are among the most diffused alloys known in the field and information about them may be retrieved from a vast variety of sources, for example from U.S. Pat. Nos. 8,152,941 and 8,430,981 in the name of SAES Smart Materials, which concern the latest developments on Nitinol, or from U.S. Pat. No. 4,830,262 in the name of Nippon Seisen relating to the basic Nitinol properties.

Ni—Ti—Cu based shape memory alloys are also suitable for the purposes of the invention. Information about these alloys may e.g. be found in U.S. Pat. No. 4,337,090 to Raychem.

All these alloys feature a good ductility, superelastic features and an optimal corrosion resistance. Moreover, these alloys are not magnetic and have the ability to recover deformations up to about 8.5%.

Shape memory alloys featuring electrical resistivity and transition temperatures particularly suitable to be heated due to Joule effect by employing power sources typically present on sailboats, such as for example batteries, will preferably be chosen.

In a second aspect the invention consists in a sailboat control apparatus for sailboats, said apparatus comprising electric terminals configured to be connected to at least one pair of shape memory systems operably connected to the sail structure in correspondence to at least one of its battens. The control apparatus further comprises an electric interface and an electrical power source operably connected to said electric interface, wherein the electric interface is configured to selectively supply electric current to the shape memory systems.

The electric current is supplied to only one shape memory system at a time for each batten, so that they are alternately actuated. The bending degree depends on the current intensity.

It is also theoretically possible to supply electric currents with different intensities to each shape memory system of a pair so as to reach a desired bending degree. However, this solution is not practicable due to complexity of control and related costs.

Selective operation of the shape memory systems operably connected to the sail battens allows fine adjustment of the sail even at individual portions thereof depending on the wind conditions.

Current supply to the shape memory systems may be manually or automatically driven by means of the aforementioned sensors. Moreover, some shape memory alloy wires of the shape memory systems could be calibrated to automatically react to a deformation/elongation of the shape memory wire, as those element will follow the sail curvature, to automatically compensate for it.

Finally, in a third aspect thereof the invention consists in a method for controlling operation of a sailboat sail, said method comprising the steps of:

i) providing a sail with at least one pair of shape memory systems comprising shape memory elements made of a shape memory alloy or of a shape memory polymer, said shape memory systems being embedded in the sail structure or applied to its faces by way of soldering, gluing, sewing, molding, lamination, printing, crimping or combinations thereof;

ii) arranging and operably connecting the shape memory systems of the at least one pair in correspondence to at least one sail batten on the opposite longitudinal sides thereof relative to the sail surface, iii) selectively supplying an electric current to the shape memory systems so arranged.

As discussed above, electric current is supplied to only one shape memory system at a time for each batten so that they are alternately actuated.

The present invention has hereto been disclosed with reference to preferred and non-limiting embodiments thereof. It will be understood that there may be other embodiments relating to the same inventive idea as defined by the scope of protection of the claims set forth below.

The invention claimed is:

1. A sail for sailboats, said sail comprising one or more battens wherein the sail further comprises at least one pair of shape memory systems comprising one or more shape memory elements, said shape memory systems being arranged in correspondence of at least one said battens and being operably connected to the sail opposite faces or directly to the battens so as to face the opposite faces of the sail, and in that said shape memory systems extend along said battens.

2. A sail according to claim 1, wherein said shape memory systems extend over at least 75% of the batten length.

3. A sail according to claim 1, wherein said shape memory systems are mounted on the battens.

4. A sail according to claim 3, wherein said shape memory systems are connected to or close to the batten ends.

5. A sail according to claim 1, wherein the shape memory systems are embedded in the sail structure.

6. A sail according to claim 1, wherein said battens are housed in respective pockets formed in the sail.

7. A sail according to claim 6, wherein the shape memory systems are arranged on portions of the surfaces of batten pockets.

8. A sail according to claim 1, wherein said shape memory elements are chosen from shape memory wires, shape memory ribbons.

9. A sail according to claim 1, wherein said shape memory systems comprise elements made of shape memory polymers or shape memory alloys.

10. A sail according to claim 9, wherein said shape memory elements are made of a shape memory alloy having an austenitic phase starting temperature that is 10-20° C. higher than its martensitic phase completion temperature.

11. A sail according to claim 10, wherein said shape memory alloy has a martensitic phase completion temperature equal to or higher than 40° C.

12. A sail according to claim 10, wherein said shape memory alloy is a Ni—Ti alloy or a Ni—Ti—Cu alloy.

13. A sail according to claim 1, wherein said shape memory systems comprise shape memory elements in the form of wires and wherein said wires have a diameter comprised between 0.1 and 2 mm.

14. A control apparatus for controlling operation of a sailboat sail according to claim 1, said control apparatus comprising electric terminals configured to be connected to shape memory systems of said sail, the control apparatus further comprising an electric interface and an electrical power source operably connected to said electric interface, wherein the electric interface is configured to selectively supply electric current to each shape memory system.

15. A control apparatus according to claim 14, further comprising current adjusting means, said means comprising a manual driver operably connected to the electric interface and/or a microprocessor operably connected to the electric interface and provided with a control program.

16. A control apparatus according to claim 14, further comprising one or more sensors configured to be installed at predetermined positions of the sail, said sensors being operably connected to a microprocessor through a circuit and/or a wireless connection by way of an antenna.

17. A control apparatus according to claim 16, wherein said sensors comprise pressure, strain, distortion, wind speed and wind direction sensors.

18. A method for controlling operation of a sailboat sail, said method comprising the steps of:

i) providing a sail with at least one pair of shape memory systems comprising one or more shape memory elements made of a shape memory polymer or of a shape memory alloy;

ii) arranging the shape memory systems of the at least one pair in correspondence to at least one batten;

iii) operably connecting the shape memory systems of the pair to the sail opposite faces or directly to the batten so as to face the opposite faces of the sail; and iv) selectively supplying an electric current to the shape memory systems to only one shape memory system at a time for each batten.

19. A control method according to claim 18, wherein current supply is controlled manually, automatically and/or semi-automatically.

20. A control method according to claim 19, wherein current supply is controlled automatically based on a control program stored in a microprocessor of a control apparatus and on external inputs provided by a number of sensors installed on the sail or on a sailboat where the sail is mounted.

21. A control method according to claim 20, wherein said external inputs comprise pressure, strain, distortion of the sail and wind speed and direction.

22. A control method according to claim 19, wherein current supply is controlled based on the resistance value of shape memory wires forming the shape memory systems of the sail.

23. A control method according to claim 22, wherein current is controlled such that the ratio between current and wire diameter is comprised between 1000 and 10000 mA/mm.

24. A sail according to claim 2, wherein said shape memory systems extend over 90% of the batten length.

* * * * *